United States Patent [19]

Sampson et al.

[11] 4,037,447

[45] July 26, 1977

[54] PLANETARY STRAIGHTENING MACHINE

[75] Inventors: Sheldon E. Sampson, Davisburg; Don A. Cargill, Bloomfield Hills, both of Mich.

[73] Assignee: Cargill Detroit Corporation, Clawson, Mich.

[21] Appl. No.: 669,478

[22] Filed: Mar. 23, 1976

[51] Int. Cl.[2] ..... B21D 3/16; B21D 13/00; B21D 53/00

[52] U.S. Cl. ..... 72/92

[58] Field of Search ..... 72/92, 91, 93, 160

[56] References Cited

U.S. PATENT DOCUMENTS

| | | | |
|---|---|---|---|
| 2,550,842 | 5/1951 | McClure et al. | 72/92 |
| 2,622,654 | 12/1952 | Frank | 72/93 |
| 3,930,392 | 1/1976 | Matej | 72/92 |

FOREIGN PATENT DOCUMENTS

| | | | |
|---|---|---|---|
| 978,949 | 1/1965 | United Kingdom | 72/93 |

*Primary Examiner*—Milton S. Mehr

[57] ABSTRACT

A planetary production workpiece processing machine having a rotatable annular drum with circumferentially extending planetary workpiece engaging tooling and opposed fixed reaction tooling providing a progressively variable relative radial tooling spacing for rolling and variably stressing the planetary workpiece beyond elastic limit as it progresses from an entrance to an exit portion of the machine. Processing operations may include straightening of linear workpieces with rapid and gradually reduced deflection or progressive reduction forming of the workpiece. Multiple diameters in a linear workpiece are accommodated through the use of free floating as well as power driven drum elements.

12 Claims, 18 Drawing Figures

64
63
71
71
70
69
67
67
65
66

74
72
73
74
75

79
78
76
77
80
78

PLANETARY STRAIGHTENING MACHINE

BACKGROUND OF THE INVENTION

Automatic straightening machines have been employed for linear cylindrical workpieces wherein deflecting rollers are programmed to deflect the workpiece beyond yield and gradually relax the deflection while the workpiece is rotating. In such case the deflecting rollers must be retracted for loading each workpiece and a driving chuck is normally employed to grasp and rotate the workpiece.

Linear machines have also been employed for straightening, thread rolling and similar operations wherein deflecting or forming linear tooling causes the workpiece to roll during advance movement of a slide actuated by a hydraulic cylinder or the like. At the end of the full stroke, the straightened or formed parts roll out and the slide is retracted to a position for loading the next part. The closest prior art known to applicant is a machine for straightening pipe disclosed in U.S. Pat. No. 2,550,842 wherein pipe is rolled by a drum having axially spaced deflecting rolls against intermediate fixed bearing shoes uniformly radially spaced concentrically from the circumference of the straightening rolls by a distance sufficiently less than the outside diameter of the pipe that a straight pipe length passing between the rolls and the bearing shoes is bent approximately to its elastic limit. A pipe length that is not straight is thus bent beyond its elastic limit sufficiently so that its elasticity straightens it as it emerges from the machine. Since the arc of the bearing shoes is concentric with that of the straightening rolls, the pipe diameter, wall thickness and heat treatment relative to elastic limit must be accurately matched to the uniform deflection in order to achieve accurate straightening.

SUMMARY OF THE INVENTION

Applicant employs a rotating drum with circumferential tooling adapted to roll a "planetary" workpiece against fixed reaction tooling having a progressively varying relative radial spacing to the tooling of the rotating drum. Such spacing in the case of straightening operations is programmed to provide rapid deflection of the linear workpiece slightly beyond yield followed by gradually increased radial spacing coordinated with the tolerance limits for straightness so that the increase in relative radius per revolution of the workpiece will assure straightness within tolerance, notwithstanding dimensional, hardness or other workpiece variations affecting the margin of deflection at which yield takes place or ceases during relaxation. Applicant's drum size and fixed tooling path relative to the circumference of the workpiece will normally provide multiple revolutions of the workpiece and may include a final portion beyond the processing stage for gauging and separating out-of-tolerance workpieces.

A cascading loading device is provided at the entrance for individually introducing parts in timed relation with the drum rotation and may include a cage for maintaining orientation of the workpiece where configuration is such as to otherwise permit skewing during the processing operation. Where axially spaced portions of reaction tooling are employed they are normally adapted to engage portions of the workpiece having equal diameter and provide identical spacing relative to the rotating drum tooling; however, engagement of multiple diameters of the workpiece by the rotating tooling may be acommodated by establishing drive at a single diameter and providing free floating bearings for any other rotating tooling engaging a different diameter of the workpiece.

Forming as well as straightening operations may be performed through employment of suitable tooling.

DESCRIPTION OF THE DRAWINGS

With reference to FIGS. 1, 2 and 3 the illustrated straightening machine comprises in general a loading station A, a rotary drum B, a displacement cam C, motor drive D, gaging station E, and unload or reject station F, all mounted on a rigid base frame G. As best shown in FIGS. 4 and 5, the loading station comprises a 20-part stacker 10 which may be manually or otherwise loaded with cascading drop sections 11 to assist in maintaining part orientation and free flow to the drum B.

Figure 5:
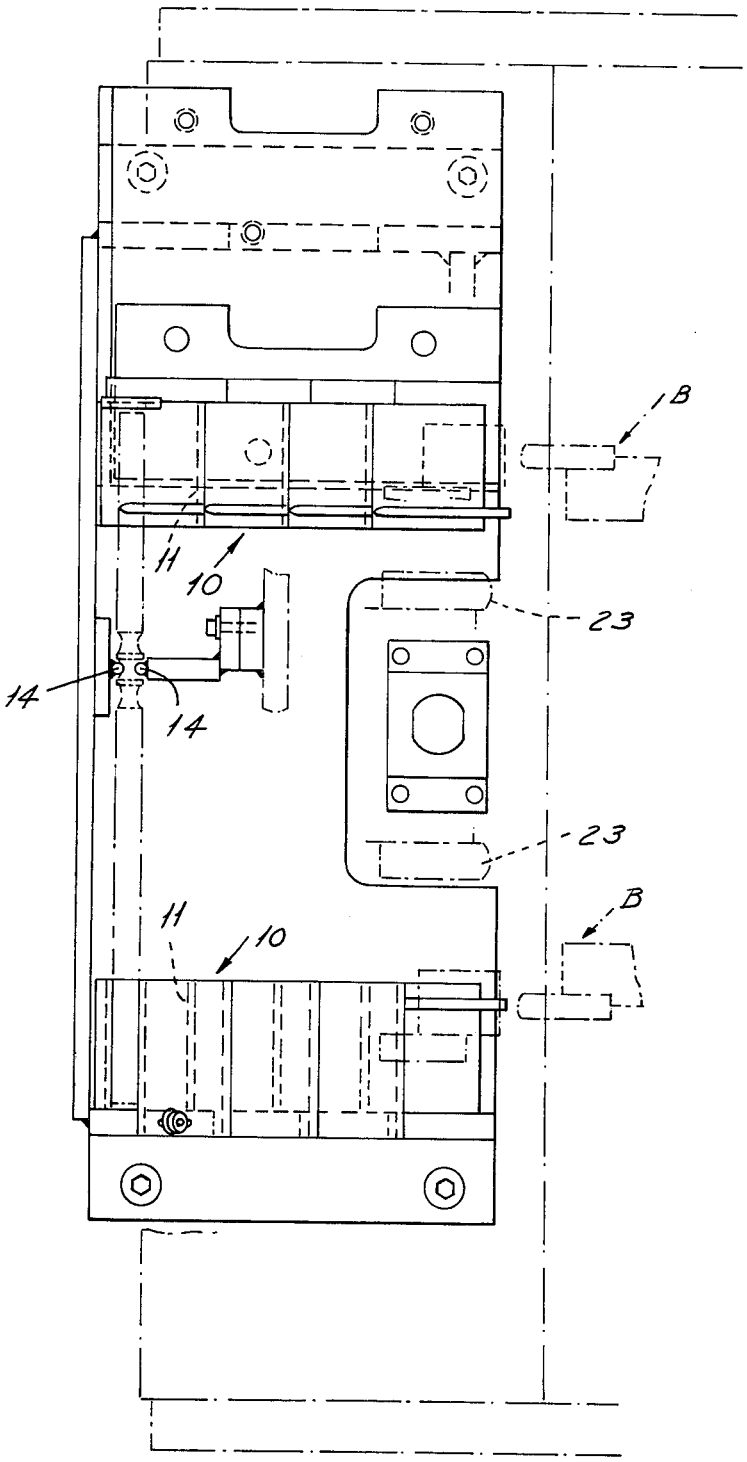
FIG. 5 is a plan view of the feed hopper shown in FIG. 4.

An escapement 12 operated by a cylinder 13 responsive to a high level switch (not shown) at the unload station protects against a high level jamming at the unload station and, as shown in FIG. 5, guide rods 14 engage a groove in the shifter rod workpieces for accurate axial positioning at the entrance of the loader.

Figure 4:
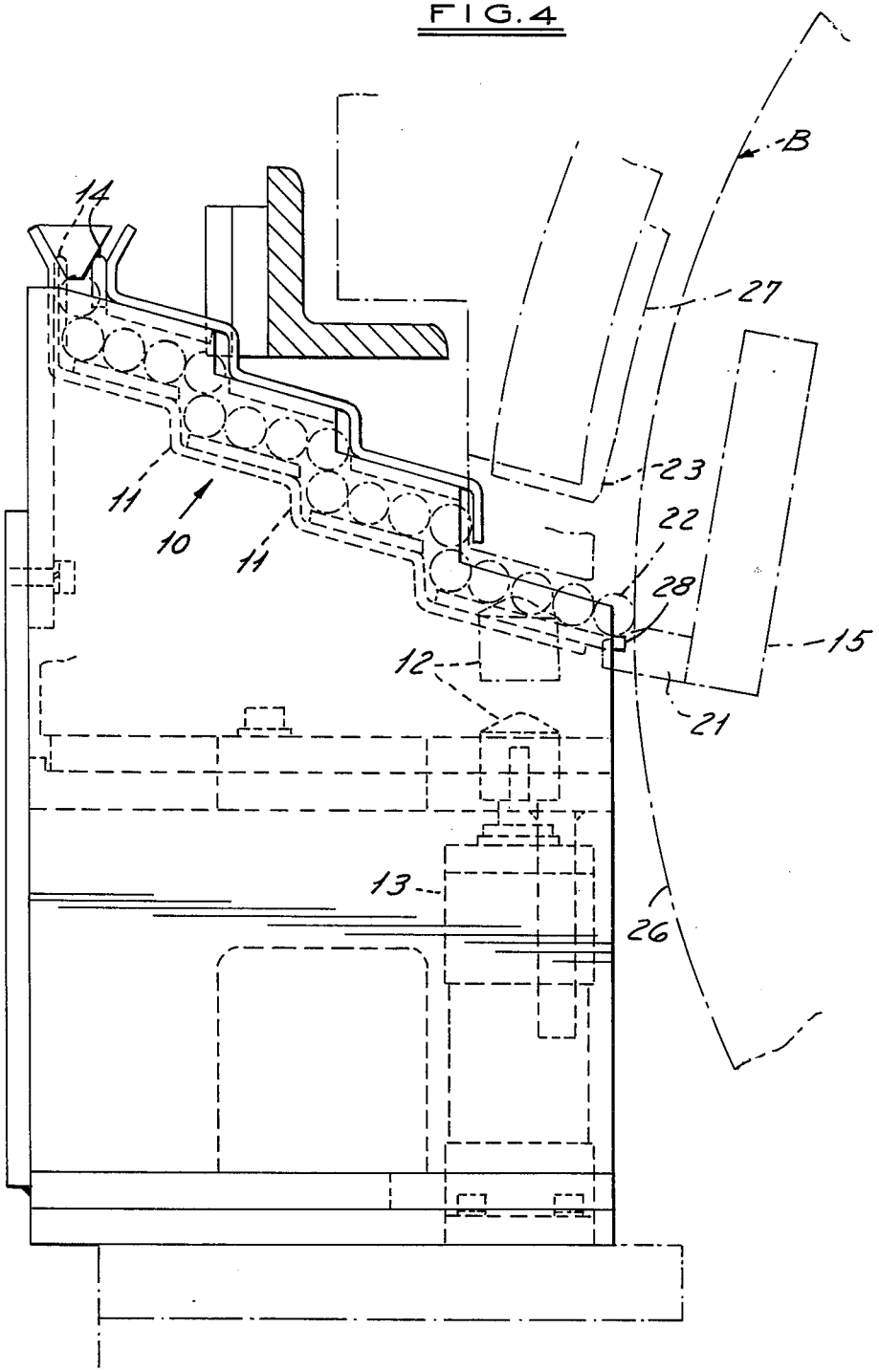
FIG. 4 is an enlarged fragmentary view of the parts feed hopper shown at the left hand side of FIG. 1 at the part entrance of the machine.
Figure 6:
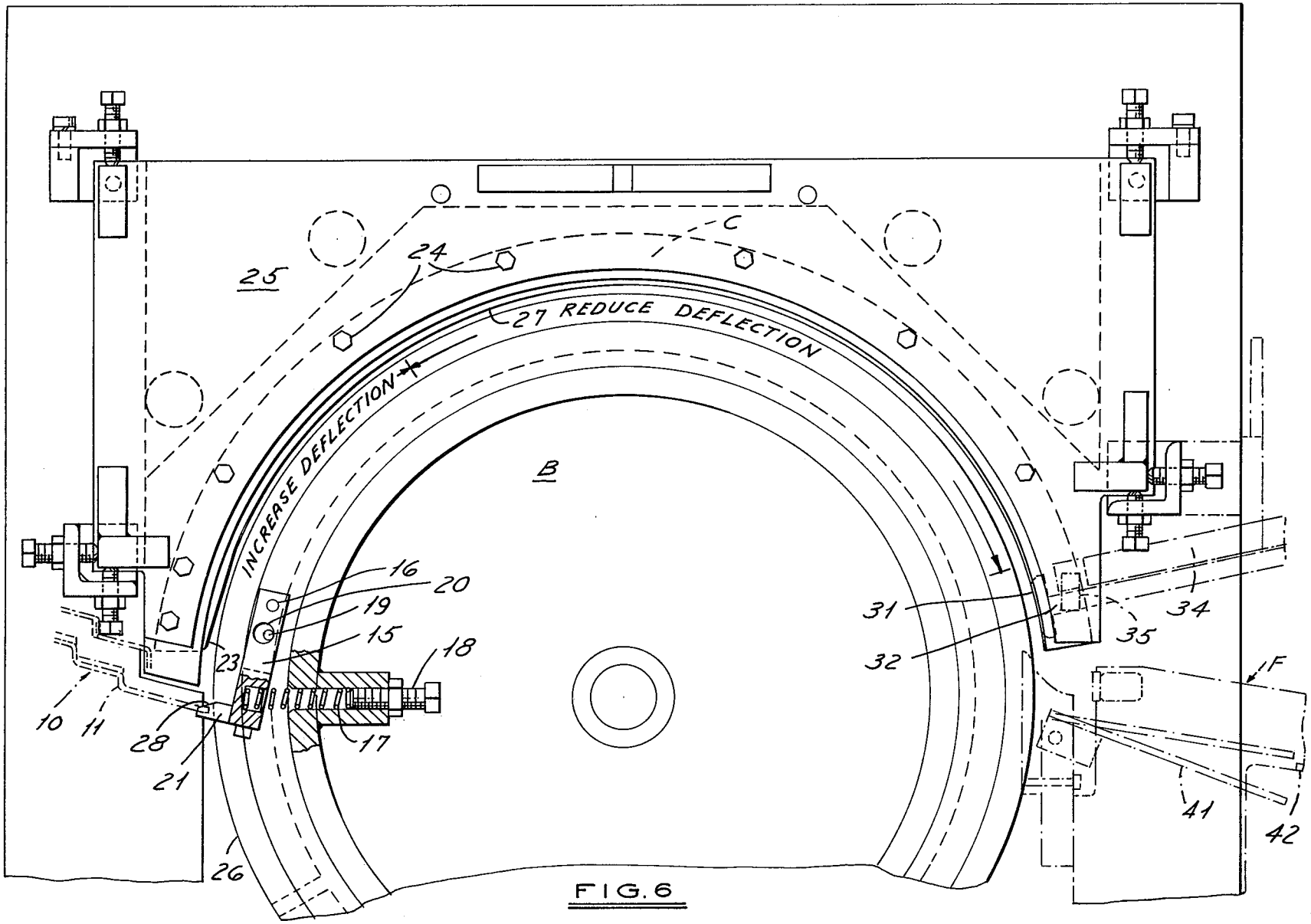
FIG. 6 is an enlarged fragmentary view of the rotary drum and displacement cam shown in FIG. 1 with the cover of the machine removed.

The rotary drum B has a pair of feed pawls 15, one of which being best shown in FIGS. 4 and 6, pivotally mounted at 16 to the outer perimeter thereof, biased by spring 17 and adjustment screw 18 to an outward position established by a limit stop 19 engaging an enlarged hole 20 in the pawl arm. A projection 21 on each of the pawls simultaneously engages the lowermost part 22 at axially spaced points raising it into engagement with an entrance ramp 23 of a pair of identical displacement cams C adjustably secured by a number of bolts 24 to frame members 25.

Upon firm wedging engagement of the workpiece between the circumferential drum or tool surface 26 and the ramp surface 23 of the displacement cam tool surface 27, a planetary rolling action on the workpiece occurs causing it to advance along the displacement cam at approximately one-half the peripheral speed of the drum surface 26 whereupon the bevelled end 28 of the pawl projection 21 together with the rotary pressure of the part 22 causes the pawl to retract against the bias of spring 17 and pass over the workpiece so that by the time the workpiece has advanced to the unload or reject station F the pawl will have completed an entire revolution for engagement with another workpiece.

Figure 7:
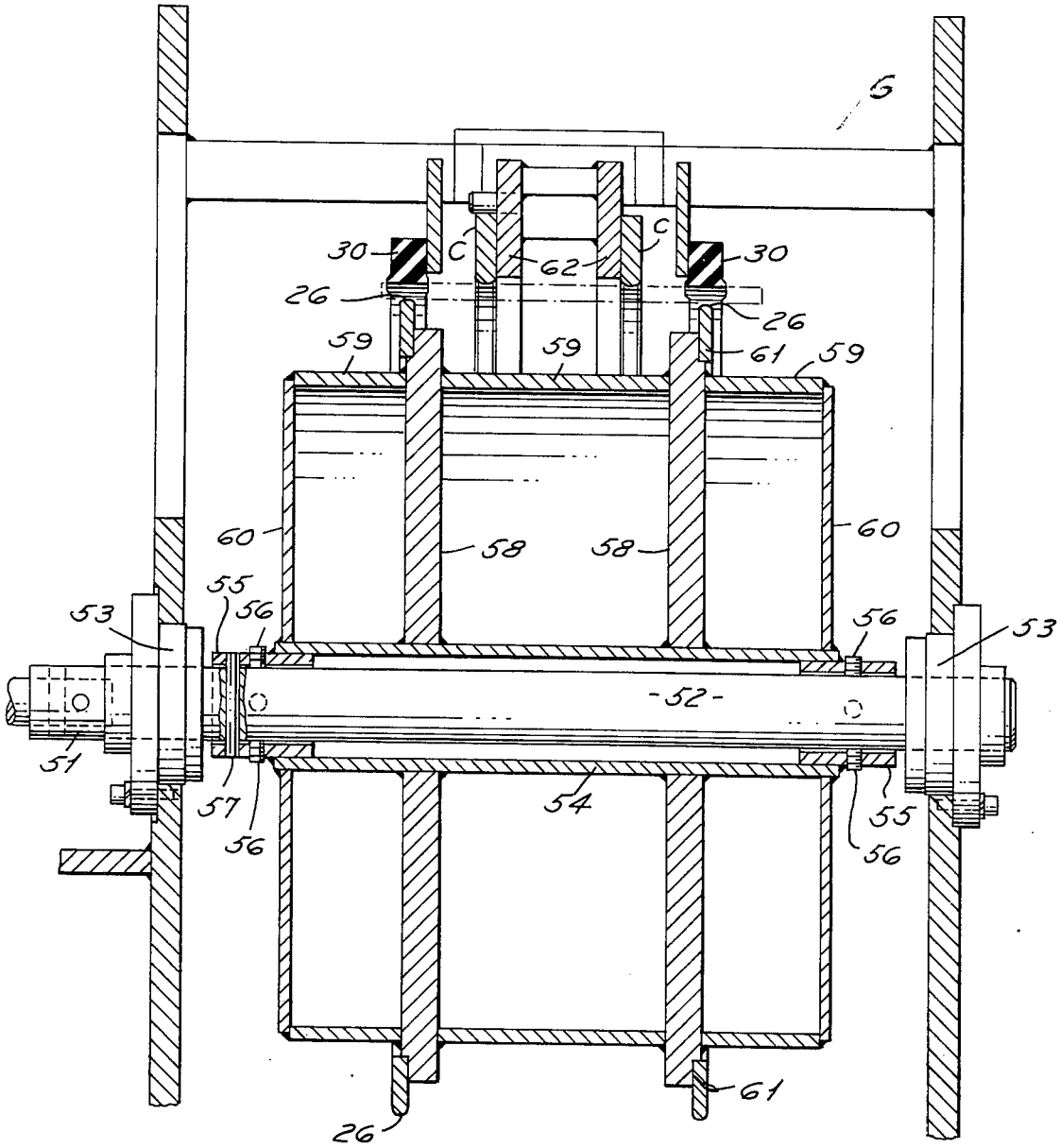
FIG. 7 is a somewhat reduced sectional view of the rotary drum and displacement cam shown in FIG. 6.

Optionally, as best shown in FIG. 7, depending on the length and characteristics of the workpiece, a pair of resilient concentric shoes 30 immediately opposite the driving drum surfaces 26 may be employed to provide and maintain positive workpiece orientation throughout the planetary straightening cycle.

With reference to FIG. 6, the tool surface 27 of the displacement cams C provide a rapid deflection of the workpiece beyond its yield point in the initial arc of travel, e.g. initial 30° followed by a gradual relative increase in the radial spacing between the drum and displacement cam tool surfaces 26 and 27 so that each successive revolution of the workpiece involves a reduction in deflection beyond yield. By providing a rate of reduction per revolution equal to or less than the allowable straightness tolerance, straightening of the workpiece within tolerance may be automatically assured regardless of tolerance variations in workpiece diameter, hardness or other factors affecting yield point versus deflection characteristics.

It will be understood that through appropriate design of the arc of the tool surface 27 and adjustable mounting of the displacement cam C relative to the drum tooling 26 a desired "program" for deflection beyond yield and gradual reduction of deflection may readily be provided to meet the requirements of the individual production workpiece. While the progressive change in relative spacing between the drum and reaction tooling may be effected by the departure of the surface of either tooling element from a concentric relationship, the preferred approach for most applications will be to incorporate such departure in the reaction surface of the stationary deflection cam C while constructing all tooling on the drum in circular form. All driving tooling on the drum should be of common diameter and should engage any axially spaced portions of the workpiece at locations of common workpiece diameter.

Figure 8:
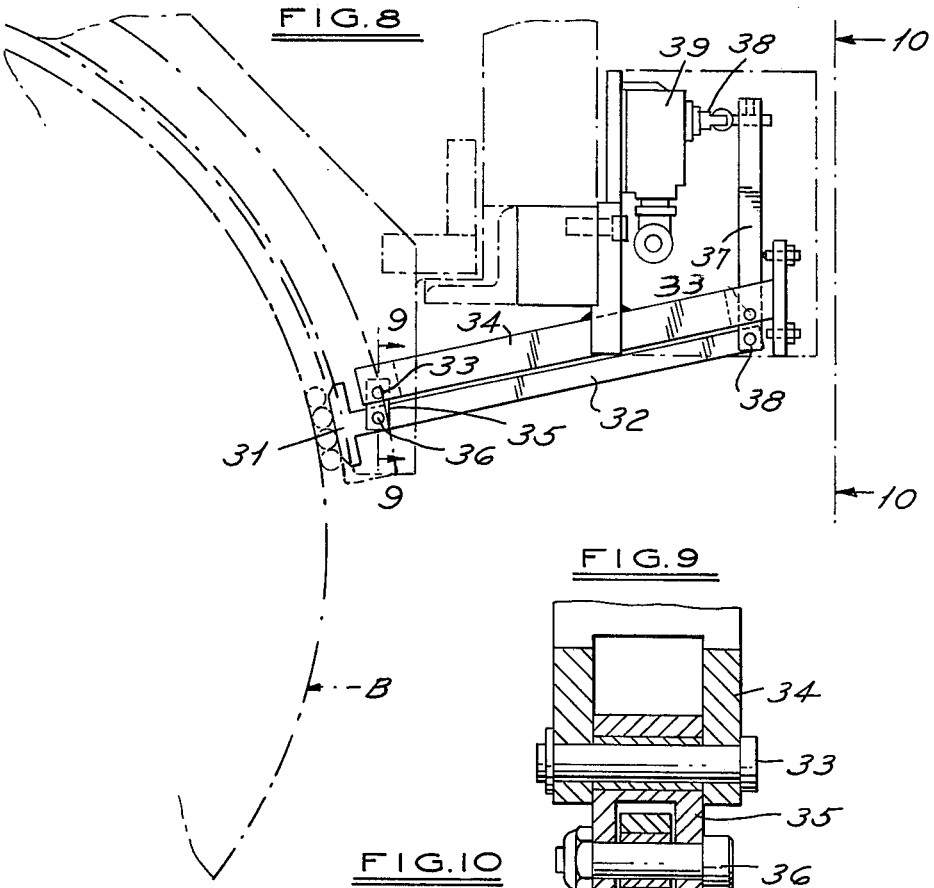
FIG. 8 is a fragmentary view of the gauging station shown at the right hand side of FIG. 6 with portions of the cover removed for clarity.
Figure 9:
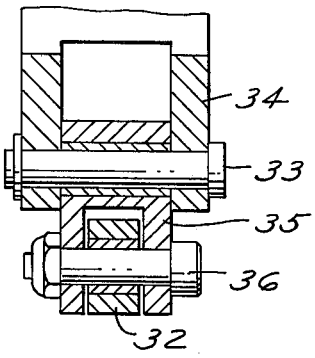
FIG. 9 is an enlarged sectional view of the pivotal suspension for the gauge head taken along the line 9—9 of FIG. 8.
Figure 10:
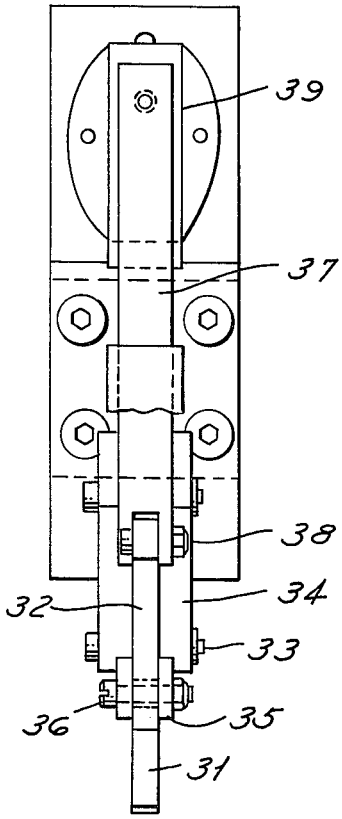
FIG. 10 is an end elevation of the gauge head taken along the line 10—10 of FIG. 8.
Figure 11:
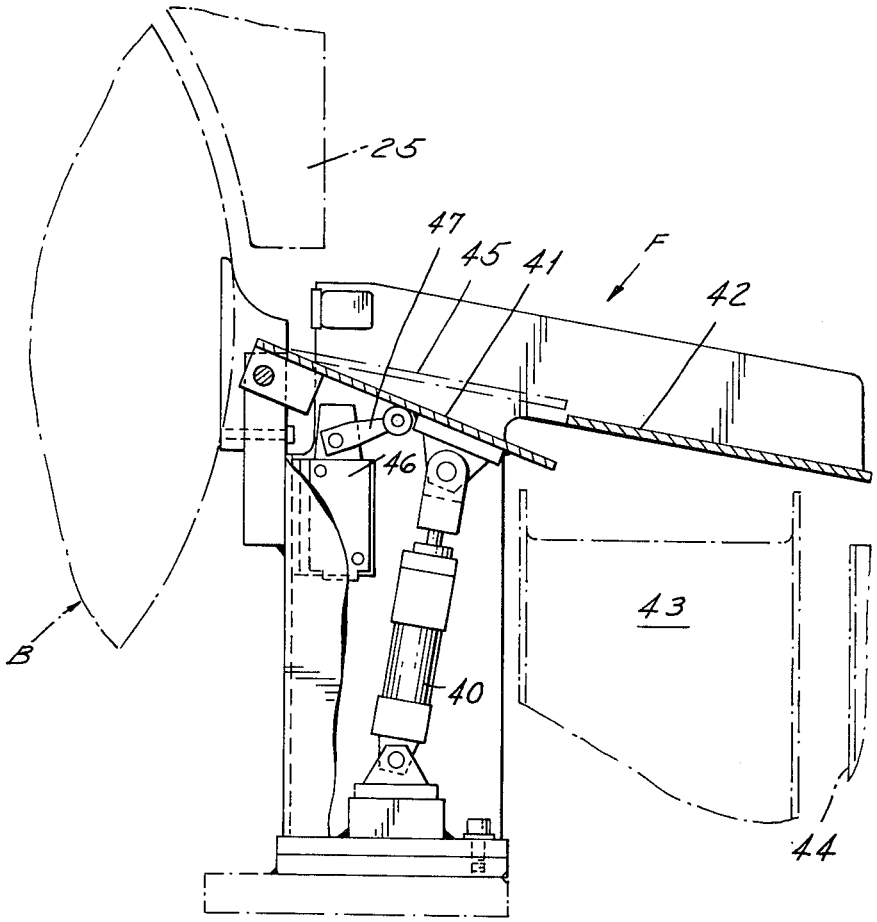
FIG. 11 is partially sectional view of the reject station illustrated at the lower right hand side of FIG. 6 with portions of the cover removed for clarity.

After passing the end of the processing arc, the workpiece may pass under a gauge head 31 which, as best shown in FIG. 8, has a mounting extension 32 pivotally suspended from a pair of pivot points 33 in a stationary support 34 by a short link 35 and pivot 36 at one end and a gauge arm 37 and pivot 38 at the other. Amplified displacement of the arm 37 will actuate a gauge mechanism 38 in response and proportional to displacement of the gauge head 31 by a workpiece passing thereunder, and any excess out-of-round part condition thereby sensed will cause a solenoid valve 39 to actuate a reject cylinder 40, as shown in FIG. 11, to move a reject door 41, in the unloading chute 42 to the solid line position shown for discharge into a reject bin 43, parts within tolerance being delivered down the continuing chute to the straightened parts bin 44. The door 41 returns to normal dotted line position 45 after each reject cycle and a counter 46 actuated by arm 47 counts the number of rejected parts.

Figure 1:
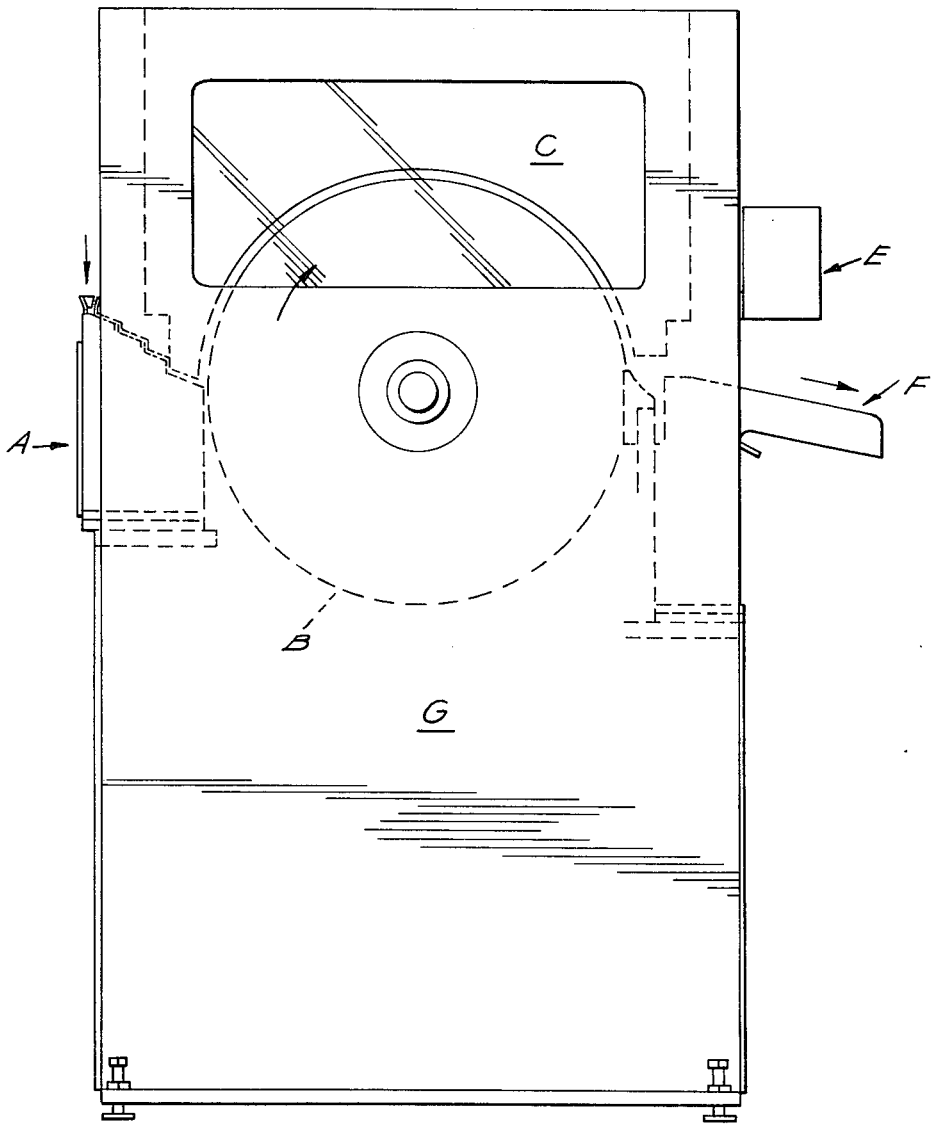
FIG. 1 is a side elevation of a typical machine constucted in accordance with the present invention for straightening automotive shifter rods.
Figure 2:
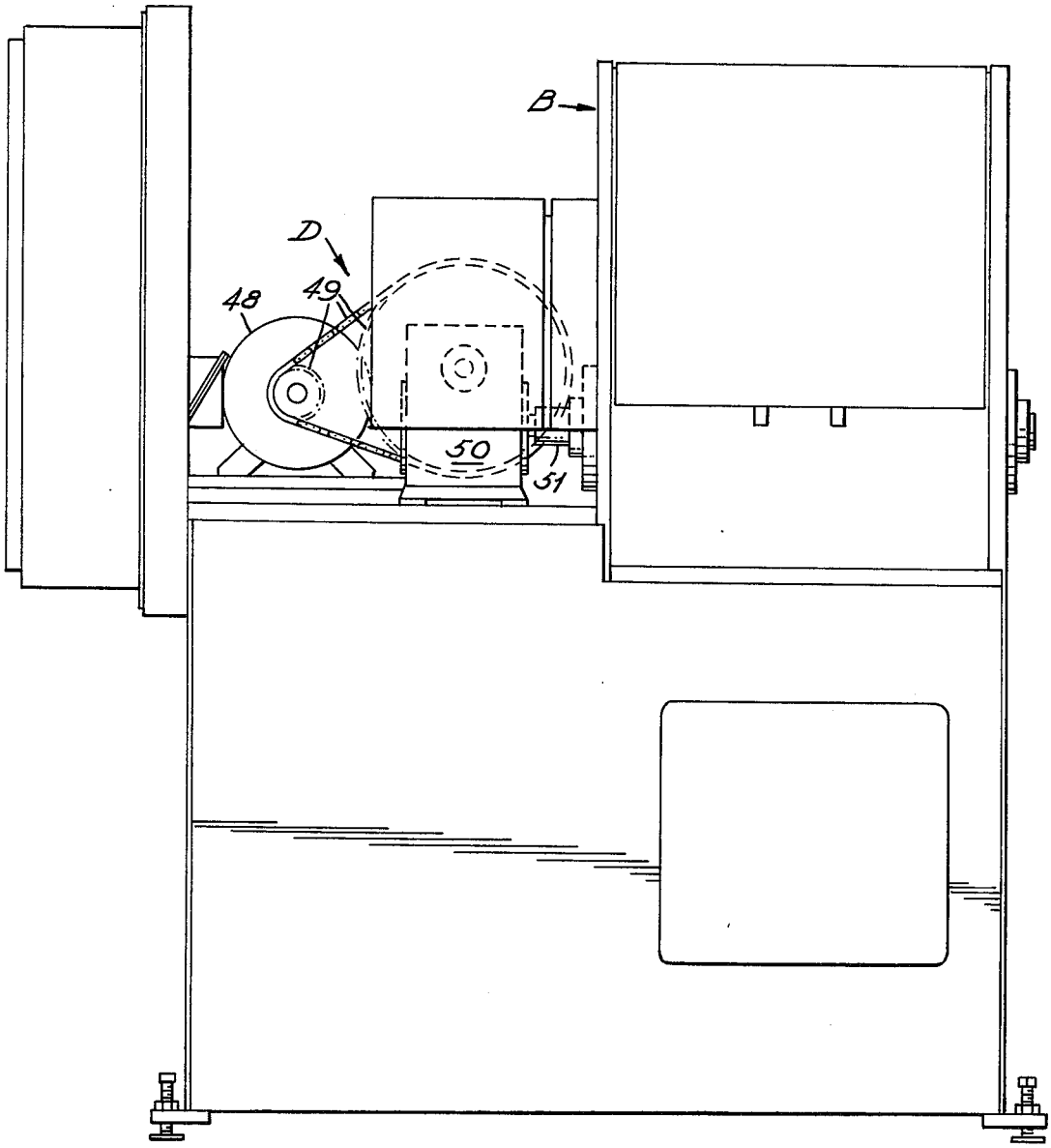
FIG. 2 is a front elevation of such machine.
Figure 3:
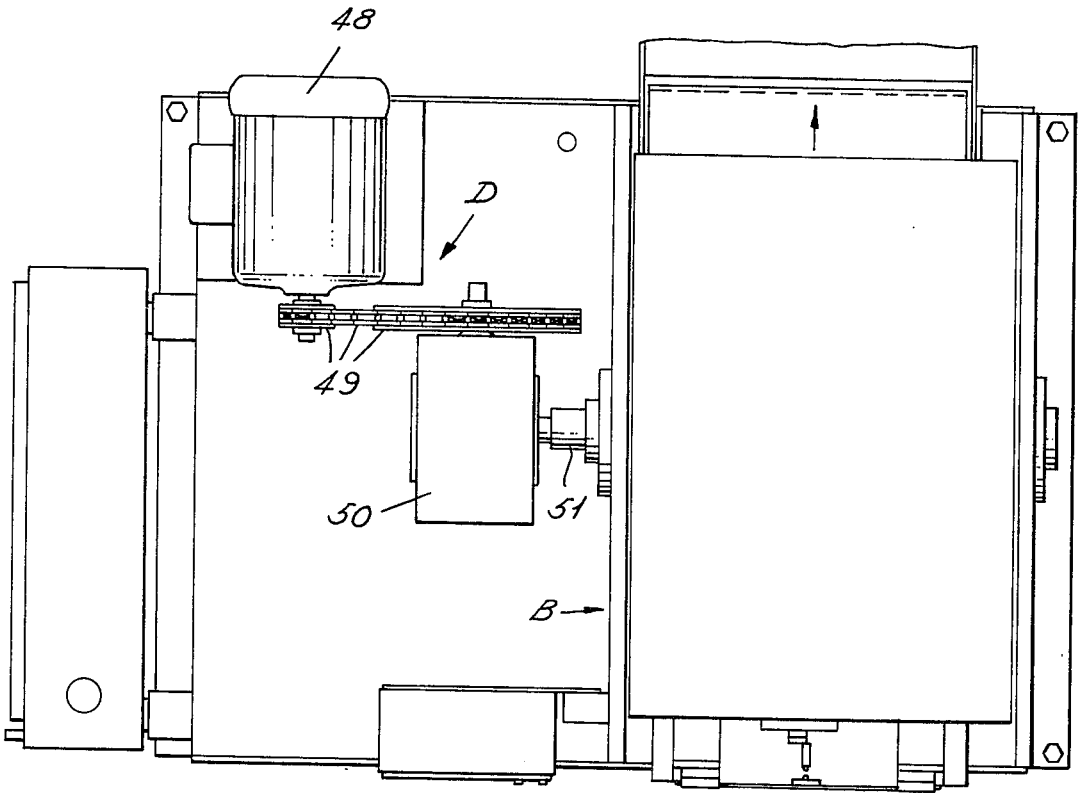
FIG. 3 is a plan view thereof.

As shown in FIG. 2 a suitable drive for the drum B is provided by an electric motor 48, positive drive chain and sprocket elements 49 and reduction gear 50 connected to drive coupling 51 and drum shaft 52 mounted suitable bearings 53 adapted to withstand radial loads imparted by the processing involved. As shown in FIG. 7 the drum is constructed with a central tube 54 welded on end bushings 55 having precision concentricity adjustment screws 56 for locating the drum radially to the shaft 52 while such bushings are driven by pin 57 extending through the bushing and shaft. A pair of heavy annular plates 58 are welded to the central tube 54 as well as central and outside drum rings 59, and end plates 60 are in turn welded to the outer ends of drum elements 59 and the central tube 54 to provide an overall rigid drum structure. The annular tooling rings 26 are suitably mounted in locating recesses 61 in the outer perimeter of removeable plates 58 preferably employed to accommodate substitution of modified tooling for different size parts as well as servicing or replacement of work tooling. The rigid frame G supports a pair of side plates 62 on which deflection cams C are adjustably bolted.

Figures 12, 13, 14:
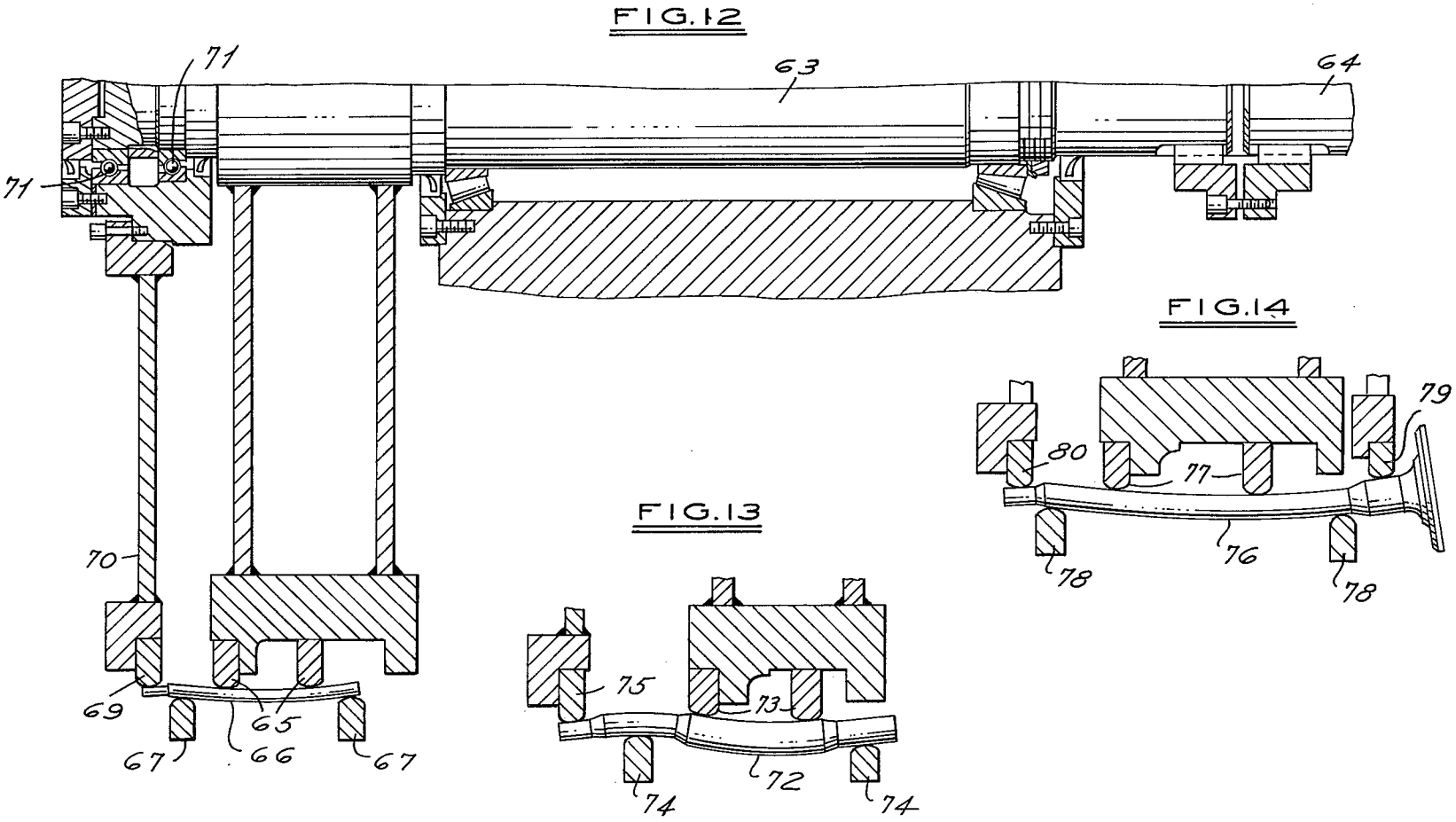
FIG. 12 is a fragmentary sectional view of a rotary drum with an auxilliary floating annulus adapted to engage a reduced diameter of a linear workpiece.
FIG. 13 is a fragmentary view similar to FIG. 12 illustrating drum tooling applied to a multiple diameter shaft of different configuration.
FIG. 14 is a fragmentary view of tooling similar to that of FIGS. 12 and 13 adapted to straighten an automotive valve having multiple diameters.

Examples of the variety of workpieces and processing operations which may be performed on this planetary machine are illustrated in FIGS. 12 to 18. FIGS. 12, 13 and 14 illustrate tooling for straightening linear parts having different diameters. In FIG. 12 the drum drive shaft 63 driven by gear box output shaft 64 rotates drum tooling elements 65 against a linear workpiece rod 66 and fixed displacement cam rails 67 with a reduced diameter 68 of the workpiece engaged by ring 69 mounted for free rotation on a floating drum element 70 in turn mounted on anti-friction bearings 71 at the end of drive shaft 63. This approach may be used where the workpiece with reduced diameter may need straightening of any kind at the reduced end as well as a general bow in the length of the rod.

FIG. 13 shows a similar application where the workpiece 72 has three diameters, the largest being engaged by a pair of driving drum rings 73, the intermediate by a pair of fixed deflection cam elements 74 and the smallest end diameter by a floating drum ring 75.

FIG. 14 illustrates a valve 76 having three diameters being straightened by engagement of a pair of drum drive elements 77 and fixed reaction deflection cams 78 all engaging a common intermediate diameter while a pair of floating drum elements 79, 80 engage respectively the large and small diameters of the valve.

Figure 15:
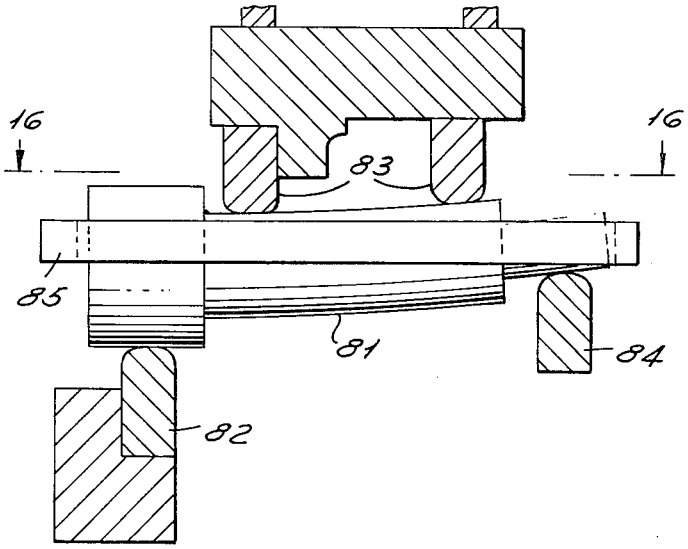
FIG. 15 is a fragmentary view of tooling adapted to engage a multiple diameter workpiece, including a cage for maintaining workpiece orientation.
Figure 16:
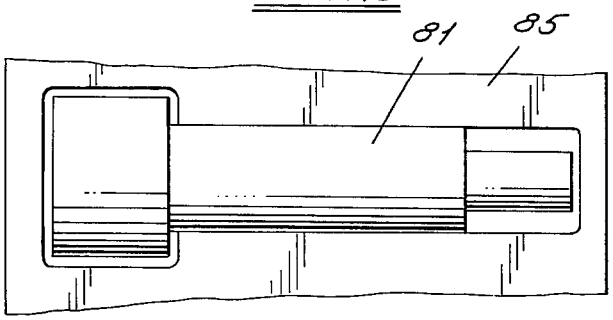
FIG. 16 is a plan view of the cage and workpiece taken along the line 16—16 of FIG. 15.

FIGS. 15 and 16 illustrate a three-step diameter workpiece 81 being straightened by engagement of a single driving drum element 82 engaging the largest diameter, a pair of fixed reaction deflection cams 83 engaging spaced portions of an intermediate diameter, and a floating drum element 84 engaging the small end diameter. In this case since the single driving and dual reaction elements would tend to produce skewing of the workpiece during its planetary rolling, an annular cage 85 mounted by a suitable means concentric with the drum (not shown) is employed to maintain workpiece orientation.

Figure 17:
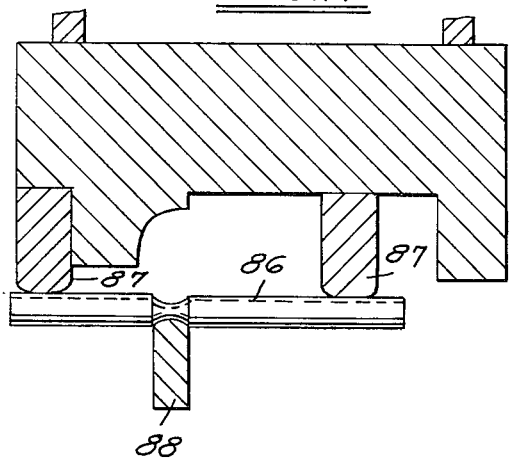
FIG. 17 is a fragmentary view of tooling, including a forming ring for forming a groove in a shaft.
Figure 18:
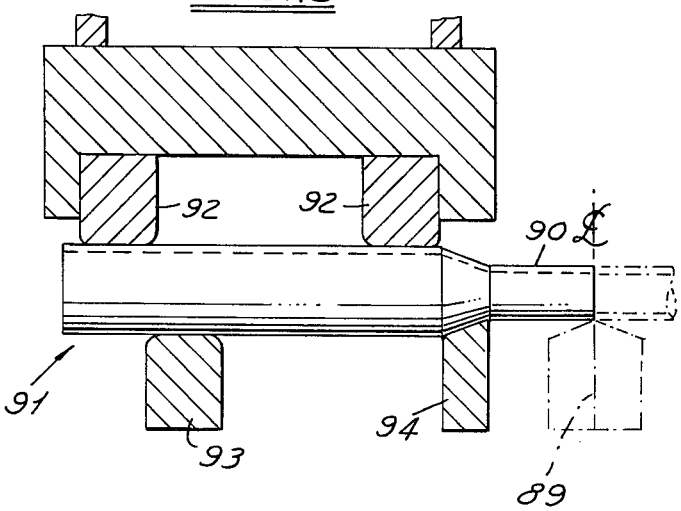
FIG. 18 is a fragmentary view of tooling, including a forming ring adapted to reduce the diameter at one end of a shaft.

FIG. 17 and 18 illustrate typical applications of forming as distinguished from straightening. In FIG. 17, a straight tubular workpiece 86 is driven by a pair of drum elements 87 against a fixed forming cam element 88 which serves to progressively neck down a central portion of the tube. Relatively wide contact lines of engagement by the drive elements 87 and a narrow forming element 88 assure a stress concentration sufficient to produce forming limited to the forming area.

With reference to FIG. 18, half of a duplicate set of tooling is illustrated at the left of centerline 89 for forming a reduced center portion 90 in a tubular workpiece 91 engaged by rotating drum elements 92, a fixed concentric reaction element 93. Forming elements 94, duplicated on each side of the centerline 89, having an initial stage for forming a reduced diameter of the tube and thereafter an axial lead for progressively extending the reduced diameter outwardly, elongating the tube in the process.

We claim:

1. A planetary production workpiece processing machine comprising;

a stationary frame, a central rigid annular element rotatably mounted on a fixed axis relative to said frame having circumferentially extending workpiece engaging tooling thereon, cooperating non-rotatably fixed non-yieldably rigid reactive workpiece engaging displacement tooling mounted on said frame in non-concentric relation adjacent to the path of said circumferential tooling extending between workpiece entering and exiting positions, said respective rotating and reactive tooling being formed with varying relative spacing accommodating and producing a planetary rolling drive and reaction engagement of the workpiece with varying relative radial displacement to perform a processing operation by stressing said workpiece beyond its elastic limit.

2. A machine as set forth in claim 1, including axially spaced portions of said tooling adapted to engage a linear workpiece stressing portions thereof beyond the elastic limit to achieve desired processing.

3. A machine as set forth in claim 2, with tooling adapted to provide a varying deflection bending stress in performing a straightening operation on said workpiece.

4. A machine as set forth in claim 3, said tooling including an initial portion providing a progressive rapid deflection of the workpiece beyond the elastic limit of a straight workpiece, followed by a portion providing a relatively gradual relaxation of deflection as the workpiece progresses towards the exit position.

5. A machine as set forth in claim 4, wherein the relaxation in deflection per revolution of the workpiece is no greater than the allowable tolerance for straightness.

6. A machine as set forth in claim 1, wherein the tooling includes means for producing a reduction forming operation on the workpiece.

7. A machine as set forth in claim 1, including tooling means for accommodating tooling engagement of different diameters of multi-diameter parts having a common axis, said means including separate power driven and free floating rotatable annular elements adapted to engage said different diameters.

8. A machine as set forth in claim 7, said reactive tooling including axially spaced portions for engaging axially spaced portions of said workpiece having equal diameter.

9. A machine as set forth in claim 1, including positive means for introducing individual workpieces at the entrance position in timed sequence with the rotation of said annular element.

10. A machine as set forth in claim 1, including a portion of said reactive tooling extending beyond the processing portion having constant relative radial relation with said rotating annular tooling, gauging means adapted to distinguish any parts outside of tolerance limits, and means to divert out of tolerance parts to a separate exit portion of the machine.

11. A machine as set forth in claim 1, including an annular cage with means for maintaining workpiece orientation from the entrance portion of said machine throughout the processing operation.

12. A machine as set forth in claim 11, said cage including means for accommodating the different diameters of multiple diameter workpieces.

* * * * *